US005201083A

United States Patent [19]

Johnson

[11] Patent Number: 5,201,083

[45] Date of Patent: Apr. 13, 1993

[54] SEATING TYPE ARTICLE OF FURNITURE CONVERTIBLE INTO A BED

[76] Inventor: Scott C. Johnson, 236 I St., Salt Lake City, Utah 84103

[21] Appl. No.: 786,712

[22] Filed: Nov. 1, 1991

[51] Int. Cl.[5] ..... A47C 17/04; A47C 17/16

[52] U.S. Cl. ..... 5/38; 5/37.1

[58] Field of Search ..... 5/38, 37.1, 47, 12.1

[56] References Cited

U.S. PATENT DOCUMENTS

| | | | |
|---|---|---|---|
| 2,751,605 | 6/1956 | Sogge | 5/38 |
| 2,954,567 | 10/1960 | Abahan | 5/38 |
| 4,616,370 | 10/1986 | Keenan et al. | 5/2.1 |
| 4,996,730 | 3/1991 | Fireman et al. | 5/37.1 |

FOREIGN PATENT DOCUMENTS

| | | | |
|---|---|---|---|
| 1032494 | 6/1958 | Fed. Rep. of Germany | 5/38 |

*Primary Examiner*—Alexander Grosz

*Attorney, Agent, or Firm*—Mallinckrodt & Mallinckrodt

[57] ABSTRACT

An article of furniture that is convertible from a couch configuration into a bed configuration. The ability to convert the article is provided by a two pieced frame assembly including a seat section and a back section which are pivotally attached preferably at only two discreet points. The back section is provided with legs that support the back section in a horizontal position when the article is in its bed configuration which, in turn, is attached by pivots to the rear portion of the seat section and supports same. The front portion of the seat section is supported by separate legs.

9 Claims, 3 Drawing Sheets

SEATING TYPE ARTICLE OF FURNITURE CONVERTIBLE INTO A BED

BACKGROUND OF THE INVENTION

Field

This invention relates to seating types of furniture convertible for use as beds.

State of the Art

Various types of convertible sofabeds have heretofore been provided. Among these are the convertible sofas shown in U.S. Pat. No. 3,747,134 issued to Josef Montiague and U.S. Pat. No. 3,747,135 issued to Andrew A. Barabas. The sofabed shown by Montiague is somewhat unusual in that the back of the sofa is used in the bed configuration to form an overhead upper bunk. Most sofabeds do not use the back portion of the sofa as a bed or part of the bed but contain a frame which folds into and is stored underneath the seat portion of the sofa as shown by Barabas.

Convertible sofabeds of the type described have the objective of providing space economy, such as in apartments where it is desired to economize on floor space. Among the shortcomings of these prior designs is the use of heavy metal frames and complicated mechanical fasteners and a plurality of pivot points which often entangle the bed linens used with them.

Accordingly, it is a general object of the invention to provide an article of furniture of seating type, such as a sofa or couch, that is convertible into a bed and which avoids a plurality of folding parts and heavy metal frames.

SUMMARY OF THE INVENTION

In accordance with the invention, the article of furniture comprises a frame assembly that includes a seat section and a back section having side members pivotally interconnected within overlapped end portions thereof by respective pivot pins that bear the weight of a person or persons seated when the article of furniture is in seating condition and that enables such article of furniture to be easily placed in either one or the other of its usable conditions as a seat or a bed.

The seat section of the frame assembly is provided with a pair of legs rigidly affixed to the forward end portions of its side members, respectively, while the back section thereof is provided with two pairs of legs, one pair being rigidly affixed to the forward end portions of its side members, respectively, and the other pair being affixed to the rearward end portions of the back section side members, respectively. Thus, the article of furniture is adequately supported as a bed constituted of seat section and back section disposed side-by-side where the back section is lowered pivotally into horizontal position from its upright seating position the seat section requiring only its forward pair of legs considering its pivotal connection with the back section. However, it is preferable that the seat section be provided, in effect, with a pair of rear legs of length selected to give a desired degree of rearward slope to the seat section when the back section is pivotally raised to place the article of furniture in its seating position. Such effective rear legs for the seat section in the seating position of the article of furniture may be provided by rearward extensions of the side members of the seat section beyond the pivots, preferably rectilinear extensions. The back section has forward extensions of the side members of its side members beyond the pivots which are preferably rectilinear. The free ends of these side member extensions seating on the floor or other surface supporting the article of furniture in its seating condition and bearing some of this load otherwise borne by the pivots.

It can be seen that the ability to convert the article of furniture from seating type to bed type is provided, in part, by the versatility of the side members of the back section. Thus, the forward ends of the side members and the front legs of the back section serve to support the back section in a substantially upright position when the article is in a seating type configuration. Also, the weight of the rear portion of the seat section transmits a downward force through the pivots which helps stabilize the back section in a substantially upright position. While in such configuration, the rear legs of the back section are not used.

To convert the article into a bed configuration, the back section is tipped back and comes to rest horizontally on its four legs. Meanwhile, the forward end portions of the side members of the back section tip upward and come to rest alongside the rear end portions of the side member of the seat section. The pivots then support the rear portion of the seat section horizontally at the same height as the back section to form a flat bed surface.

As just described, it is seen that the article of furniture converts from a seating-type article into a bed configuration with a single pair of pivots requiring no other pivot points, latches, or folding mechanism.

THE DRAWINGS

What is presently contemplated as the best mode for carrying out the invention in actual practice is illustrated in the accompanying drawings, in which:

FIG. 1 represents a perspective view of a convertible article of furniture shown in a sofa or couch configuration;

FIG. 2, a perspective view of the frame assembly of the article of FIG. 1 shown here in the bed configuration;

FIG. 3, a perspective view of the frame assembly of FIG. 2 in the sofa or couch configuration with a hidden portion indicated by a broken line;

FIG. 4, a side elevational view of the frame assembly of FIG. 2 in the bed configuration and with hidden portions being indicated by broken lines;

FIG. 5, a side elevational view of the frame assembly of FIG. 2 shown in the sofa or couch configuration and with hidden portions being indicated by broken lines; and FIG. 6, a perspective view of only the back section of the frame assembly of the article of FIGS. 2–5;

DETAILED DESCRIPTION OF THE ILLUSTRATED EMBODIMENT

Figure 1:
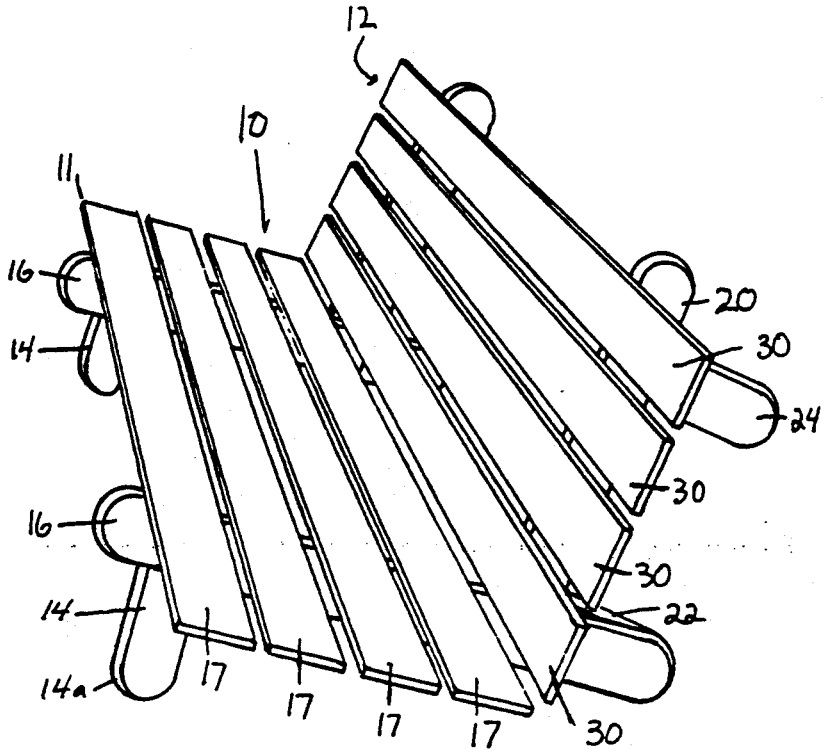
Figure 2:
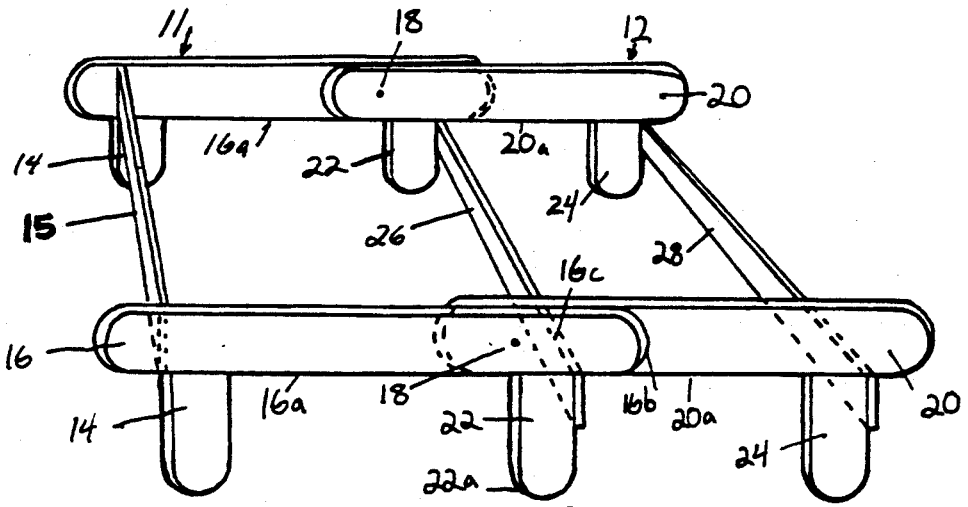
Figure 3:
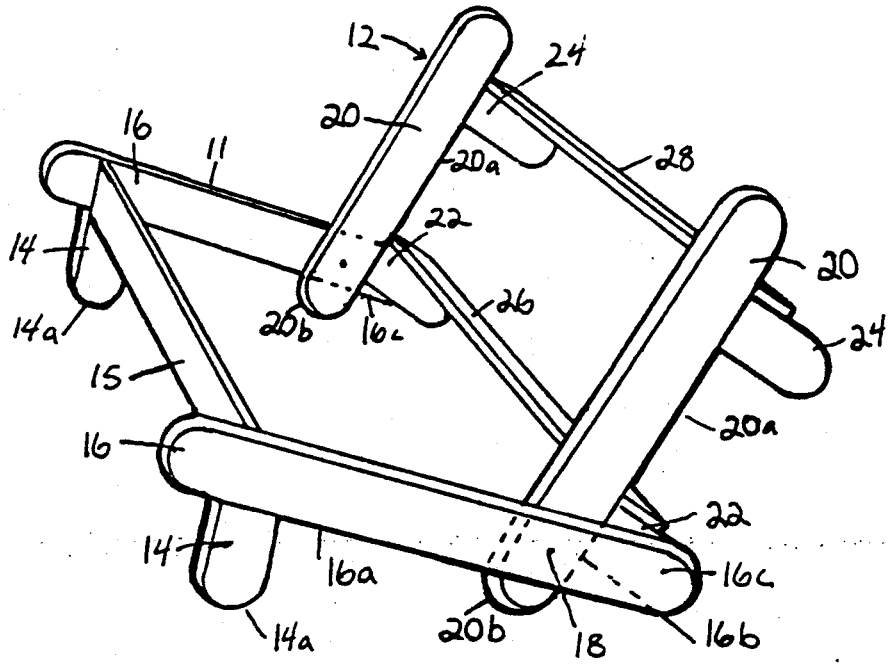
Figure 4:
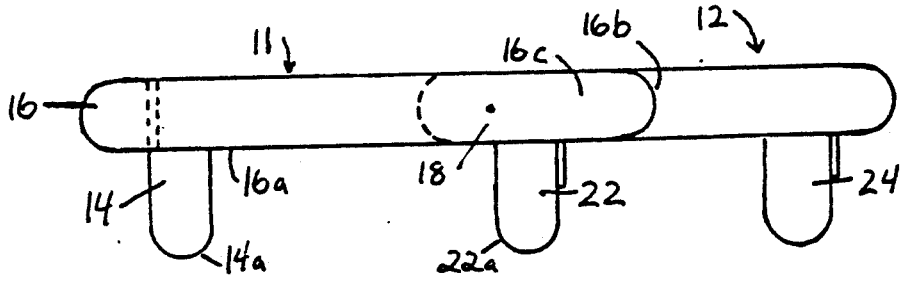
Figure 5:
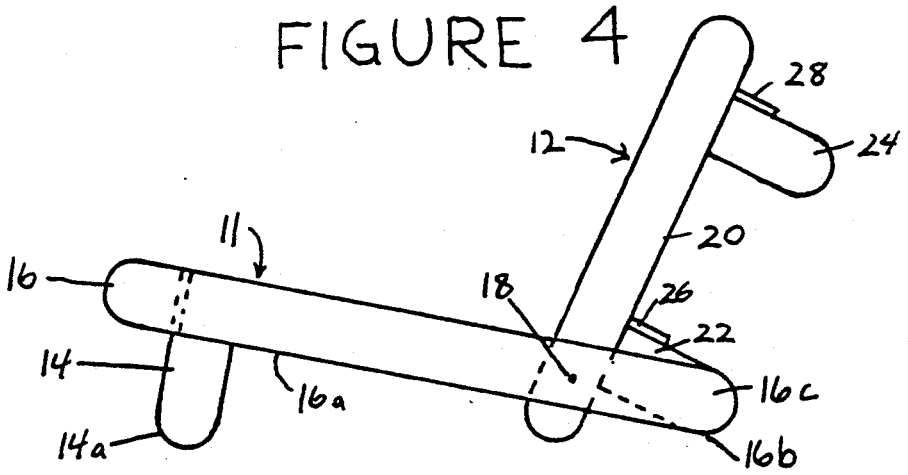

FIG. 1 shows a convertible article of furniture 10 in a sofa or couch configuration with a frame assembly having a seat section 11 and a back section 12, as best shown in FIGS. 3 and 5. However, the modestly sized sofa or couch embodiment shown in the drawings is only one of several optional embodiments. Other embodiments can be in the form of a chair, a love-seat, or a full size sofa or couch. Such optional embodiments can be formed by simply varying the width and or depth of the frame assembly.

As shown, seat section 11 of the frame assembly has a pair of opposite side members 16 which are connected and stabilized by transverse frame member 15. A pair of opposite front legs 14 is provided for seat section 11. Such legs are fixedly attached, respectively, as by tongue in groove joints and glue, to the forward, lower margin of side members 16. Additionally, as shown in FIG. 1, platform 17 extending across the top of side members 16 can be provided for supporting a cushion (not shown) for seating purposes and as part of a mattress for sleeping purposes.

FIGS. 1, 3, and 5 show seat section 11 resting in a slightly off horizontal position. The front portion of seat section 11 is supported by the legs 14 disposed underneath the forward ends of the side members at opposite sides, respectively, as best illustrated in FIG. 5. The particular legs illustrated are legs with rounded feet formed by lower margins 14*a* of legs 14 which enable a discreet point of contact, 14*a*, between the legs and the floor. While in the couch configuration, pivots 18 attach seat section 11 to back section 12 and support the rear portion of seat section 11. Optional end extensions 16*c* are extensions of side members 16 which project rearwardly beyond the pivots and provide rear legs and feet 16*b* for contact with the floor and which provide additional support for the rear portion of seat section 11.

Figure 6:
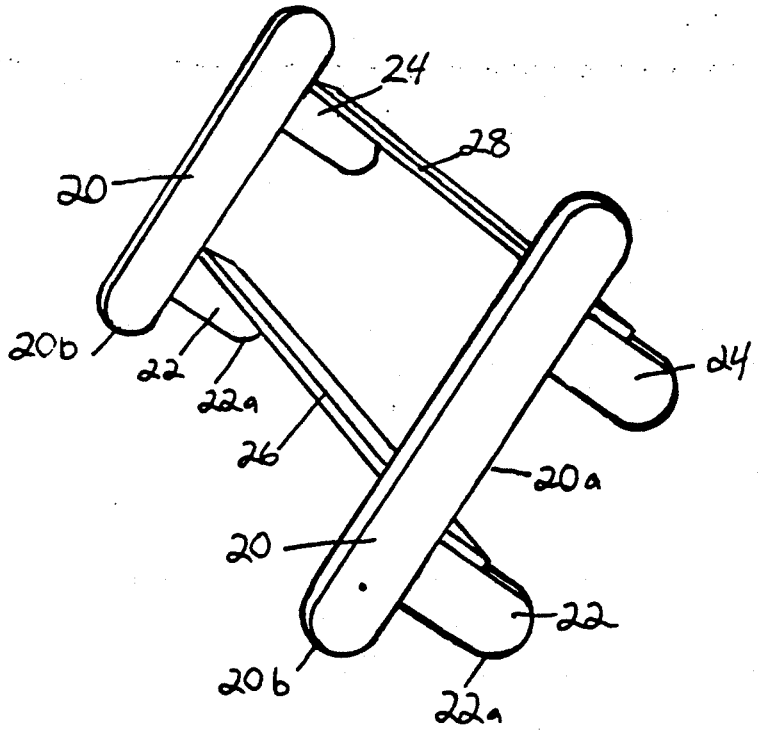

As best shown in FIGS. 3 and 6, the frame assembly of back section 12 is comprised of opposite side members 20. Back section 12 has front legs 22 and rear legs 24 at its opposite sides, respectively. Front transverse member 26 connects and stabilizes opposite front legs 22, and rear transverse member 28 connects and stabilizes opposite rear legs 24. Additionally, as shown in FIG. 1, back section 12 can include platform means 30 for attaching a cushion-mattress.

The angle off horizontal at which seat section 11 rests while in the couch configuration can be varied by varying where pivots 18 attach seat section 11 to back section 12. As shown in FIG. 5, pivots 18 attach seat section 11 to side members 20, just forward of where front legs 22 are attached to said side members. By placing the pivots farther rearwardly along side members 20, an angle that more closely approximates a horizontal position can be achieved.

Returning to legs 14 of seat section 11. As shown in the drawings, these legs are formed as discreet members. Alternatively, these members can extend along lower margins 16*a*, FIG. 5, so as to form a continuous surface in contact with the floor when the article of furniture is in the couch configuration. However, in either alternative, it is advantageous that lower, forward margin 14*a* of legs 14 be rounded as it passes from the vertical plane to the horizontal plane so that as article 10 assumes either the couch or bed configuration an adequate surface for contact with the floor is provided.

Likewise on the back section, front legs 22 and rear legs 24 can be one continuous support member along lower margins 20*a*, indicated in FIG. 5, of side members 20. However, in either alternative, similar to margin 14*a* of legs 14, it is advantageous that lower, forward margins 22*a*, FIGS. 3 and 6, be rounded so that as the article assumes either the couch or bed configuration an adequate surface for contact with the floor is provided by legs 22.

Article of furniture 10 is in the couch configuration in FIGS. 1, 3, and 5, wherein back section 12 is in a substantially vertical position. As best shown in FIG. 6, back section 12 is supported in that position by forward margins 20*b* of side members 20 and margins 22*a* of legs 22. As shown in FIG. 3, optional end extensions 16*c* also provide support that urge back section 12 to remain in a substantially upright position. In addition, the force of gravity on the rear portion of seat section 11 is transmitted through pivots 18 into side members 20 which also urges the back section to remain in a substantially upright position. Accordingly, no other latches or springs are required to urge back section 12 to remain in a substantially upright position.

Whereas this invention is here illustrated and described with reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. An article of furniture convertible from a seat to a bed and vice versa, comprising a frame assembly having a seat section and a back section pivotally interconnected; said seat section having a pair of opposite side members with means structurally interconnecting them and a pair of legs rigidly affixed to the forward end portions, respectively, of its side members for forwardly supporting said seat section in both seat and bed condition of the article of furniture; the said back section having a pair of opposite side members with means structurally interconnecting them, and pairs of legs affixed to forward and rearward end portions, respectively, of its said side members for forwardly and rearwardly supporting said back section in the bed condition of the article of furniture; and pivot means pivotally connecting rearward end portions of the side members of said seat section with forward end portions of the side members of said back section, the forward portions of the side members of said back section supporting the rear portion of the seat section in the seat condition of the article of furniture.

2. An article of furniture according to claim 1 wherein said back and seat section have a platform extending between said side members for providing a flat surface for attaching a cushion.

3. An article of furniture according to claim 2 additionally comprising a cushion covering said platform.

4. An article of furniture capable of assuming either a seating type furniture configuration or a bed configuration, comprising:

a frame assembly including a back section and a seat section;

said seat section with opposite side members, said side members having opposite legs attached to the front portions, respectively, thereof for supporting the front portion of said seat section;

said back section with opposite side members, said side members with respective opposite front and back legs attached thereto; and pivots connecting the side members of the back and seat sections;

wherein, when the assembly is in the seating type furniture configuration, said pivots support the rear portion of the seat section, the forward ends of the side members of said back section and the front legs of said back section support said back section in a substantially upright position and the weight of the rear portion of said seat section also helps support the back section in an upright position by transmitting a downward force through said pivots; and when the assembly is in the bed configuration, the front and rear legs of said back section support the back section in a horizontal position and said pivots support the rear portion of said seat section at the same height as the legs of the seat section so that said seat section is in a horizontal position.

5. An article of furniture according to claim 4 wherein said opposite front legs are connected by a front transverse member and said opposite rear legs are connected by a rear transverse member.

6. An article of furniture according to claim 4 wherein the lower, forward margins of the opposite legs for supporting the front portion of the seat section, and the lower, forward margins of the opposite front legs of the back section are rounded to provide an adequate surface for contact with the floor.

7. An article of furniture capable of assuming either a seating type furniture configuration or a bed configuration, consisting of:

a seat section with opposite side members, said side members having opposite legs attached to the front portion thereof for supporting the front portion of said seat section;

a back section with opposite side members, said side members with respective opposite front and back legs attached thereto;

pivots connecting the side members of the back and seat sections;

platform means extending between the opposite side members of the seat and back sections for providing a flat surface for attaching a cushion-mattress; and a cushion-mattress attached to said platform means;

wherein, when the assembly is in the seating type furniture configuration, the forward ends of the side members of said back section and the front legs of said back section support said back section in a substantially upright position and the weight of the rear portion of said seat section also helps support the back section in an upright position by transmitting a downward force through said pivots; and when the assembly is in the bed configuration, the front and rear legs of said back section supporting the back section in a horizontal position and said pivots support the rear portion of said seat section at the same height as the legs of the seat section so that said seat section is in a horizontal position.

8. An article of furniture convertible from a seat to a bed and vice versa, consisting of a frame assembly having a seat section and a back section pivotally interconnected; said seat section having a pair of opposite side members with means structurally interconnecting them and a pair of legs rigidly affixed to the forward end portions, respectively, of its side members for forwardly supporting said seat section in both seat and bed condition of the article of furniture; the said back section having a pair of opposite side members with means structurally interconnecting the, and pairs of legs affixed to forward and rearward end portions, respectively, of its said side members for forwardly and rearwardly supporting said back section in the bed condition of the article of furniture; and pivot means pivotally connecting rearward end portions of the side members of said seat section with forward end portions of the side members of said back section, the forward portions of the said members of said back section supporting the rear portion of the seat section in the seat condition of the article of furniture.

9. An article of furniture capable of assuming either a seating type furniture configuration or a bed configuration, comprising:

a frame assembly including a back section and a seat section;

said seat section with opposite side members, said side members having opposite legs attached to the front portions respectively, thereof for supporting the front portion of said seat section said back section with opposite side members, said side members with respective opposite front and back legs attached thereto; and pivots connecting the side members of the back and seat sections;

wherein, when the assembly is in the seating type furniture configuration, said pivots support the rear portion of the seat section, the forward ends of the side members of said back section and the front legs of said back section support said back section in a substantially upright position and the weight of the rear portion of said seat section also helps support the back section in an upright position by transmitting a downward force through said pivots; and the said members of said seat section have end extensions projecting rearwardly beyond the point where said pivots attach the seat and back sections, which when the assembly is in the seating type configuration provide rear legs and feet for said seat section; and when the assembly is in the bed configuration, the front and rear legs of said back section support the back section in a horizontal position and said pivots support the rear portion of said seat section at the same height as the legs of the seat section so that said seat section is in a horizontal position.

* * * * *